US011458349B1

(12) United States Patent
Carlson

(10) Patent No.: US 11,458,349 B1
(45) Date of Patent: Oct. 4, 2022

(54) WEIGHTLIFTING EXERCISING SYSTEM

(71) Applicant: Adam Carlson, Rochester, MN (US)

(72) Inventor: Adam Carlson, Rochester, MN (US)

( * ) Notice: Subject to any disclaimer, the term of this patent is extended or adjusted under 35 U.S.C. 154(b) by 0 days.

(21) Appl. No.: 17/504,629

(22) Filed: Oct. 19, 2021

(51) Int. Cl.

| | |
|---|---|
| ***A63B 21/078*** | (2006.01) |
| ***A63B 21/08*** | (2006.01) |
| ***A63B 21/06*** | (2006.01) |
| ***A63B 23/04*** | (2006.01) |
| ***A63B 21/00*** | (2006.01) |

(52) U.S. Cl.
CPC ..... *A63B 21/078* (2013.01); *A63B 21/00065* (2013.01); *A63B 21/0615* (2013.01); *A63B 21/08* (2013.01); *A63B 21/4035* (2015.10); *A63B 2023/0411* (2013.01)

(58) Field of Classification Search
CPC ..... A63B 21/0004; A63B 21/00058; A63B 21/00061; A63B 21/00065; A63B 21/00072; A63B 21/012; A63B 21/018; A63B 21/02; A63B 21/04; A63B 21/0421; A63B 21/0442; A63B 21/055; A63B 21/0555; A63B 21/06; A63B 21/0608; A63B 21/0615; A63B 21/0616; A63B 21/0617; A63B 21/072; A63B 21/0724; A63B 21/075; A63B 21/08; A63B 21/1681; A63B 21/22; A63B 21/4023; A63B 21/4033; A63B 21/4047; A63B 21/4049
See application file for complete search history.

(56) References Cited

U.S. PATENT DOCUMENTS 2,855,199 A * 10/1958 Noland ..... A63B 21/0616 482/97
4,502,681 A * 3/1985 Blomqvist ..... A63B 21/04 482/130
5,116,297 A * 5/1992 Stonecipher ..... A63B 21/0615 482/137
5,277,684 A * 1/1994 Harris ..... A63B 21/4047 482/121

(Continued)

FOREIGN PATENT DOCUMENTS

AU 2020101445 5/2018

OTHER PUBLICATIONS

Morning Lifter, DIY Leg Curls and Leg Extensions with Lever Arms [online], Publish [Aug. 31, 2020], <URL: https://www.youtube.com/watch?v=ZUhDfCAL6KM> (Lifter) (Year: 2020).*

*Primary Examiner* — Nyca T Nguyen
*Assistant Examiner* — Zachary T Moore

(57) ABSTRACT

A weightlifting exercising system includes a frame having a pair of columns. A pair of lifting assemblies is provided and each of the columns has one of the lifting assemblies mounted thereon. The lifting assemblies each include a mount and an axle extending through the mount and rotational relative to the mount. A first arm is fixedly attached to the axle. A second arm is rotationally coupled to the axle. A lift angle is defined between the first and second arms and is alterable from 0° to 180°. A locking member releasably locks the second arm with respect to the axle such that the lift angle is releasably retained. One of the first and second arms has a handle attached thereto and the other of the first and second arms has a weight receiver attached thereto. One or more weight plates is removably positionable on the weight receiver.

14 Claims, 19 Drawing Sheets

(56) References Cited

U.S. PATENT DOCUMENTS

| | | | | |
|---|---|---|---|---|
| 6,652,430 | B2 * | 11/2003 | Lapcevic | A63B 21/0552 482/133 |
| 7,442,153 | B1 * | 10/2008 | Chasnov | A61H 1/0292 482/140 |
| 10,016,648 | B2 | 7/2018 | Briley | |
| 10,422,473 | B2 | 9/2019 | Inouye | |
| 2002/0119871 | A1 * | 8/2002 | Fulks | A63B 21/159 482/93 |
| 2003/0134723 | A1 * | 7/2003 | Greenland | A63B 21/078 482/104 |
| 2004/0209752 | A1 * | 10/2004 | Thonn, Jr. | A63B 21/4047 482/140 |
| 2006/0172869 | A1 * | 8/2006 | Zachary | A63B 21/4031 482/94 |
| 2007/0155595 | A1 * | 7/2007 | Rogers | A63B 21/4035 482/94 |
| 2007/0155596 | A1 * | 7/2007 | Rogers | A63B 21/4047 482/97 |
| 2009/0017995 | A1 * | 1/2009 | Freiberg | A63B 23/03583 482/91 |
| 2009/0192026 | A1 * | 7/2009 | Mason | A63B 21/4005 482/97 |
| 2019/0099636 | A1 | 4/2019 | Schmidt | |
| 2019/0201734 | A1 * | 7/2019 | Sorin | A63B 21/159 |
| 2019/0217148 | A1 | 7/2019 | Bruni | |
| 2019/0269963 | A1 * | 9/2019 | Steenekamp | A63B 21/0616 |
| 2019/0275363 | A1 * | 9/2019 | Jones | A63B 21/078 |
| 2020/0094096 | A1 * | 3/2020 | Sorin | A63B 21/4009 |
| 2020/0197737 | A1 | 6/2020 | Kistner | |

* cited by examiner

WEIGHTLIFTING EXERCISING SYSTEM

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to exercising device and more particularly pertains to a new exercising device for allowing a person to perform a wide variety of lifting exercises with adjustments to an angle formed a pair of arms pivotally coupled together, wherein one of the arms includes a handle grip and the other includes weights. Additionally, the device herein is mountable to a squat rack type frame and allows for the lowering and raising of the arms to further increase the number of exercises that can be performed by a user of the device.

(2) Description of Related Art Including Information Disclosed Under 37 CFR 1.97 and 1.98

The prior art relates to exercising devices that allow for the manipulation of weights during pulling and pushing type of exercises typically associated with working out muscles in the chest, back, shoulders and arms. However, these devices tend to be limited to a specific area of the body, such as back, and are not well suited for other areas of the body. Thus, multiple exercise machines are required for a complete body workout. The invention described herein provides for multiple exercise variations such that a single piece of exercise equipment allows for a more complete body workout.

BRIEF SUMMARY OF THE INVENTION

An embodiment of the disclosure meets the needs presented above by generally comprising a frame including a pair of columns. A pair of lifting assemblies is provided and each of the columns has one of the lifting assemblies mounted thereon. The lifting assemblies each include a mount releasably engaging one of the columns. An axle, having a rotational axis, extends through the mount and is rotational relative to the mount. A first arm is fixedly attached to the axle such that movement of the first arm rotates the axle. A second arm is rotationally coupled to the axle. A lift angle is defined between the first and second arms wherein the axle defines a vertex of the lift angle and wherein the lift angle is alterable from 0° to 180°. A locking member releasably locks the second arm with respect to the axle such that the lift angle is releasably retained. One of the first and second arms has a handle attached thereto and the other of the first and second arms has a weight receiver attached thereto. One or more weight plates is removably positionable on the weight receiver.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
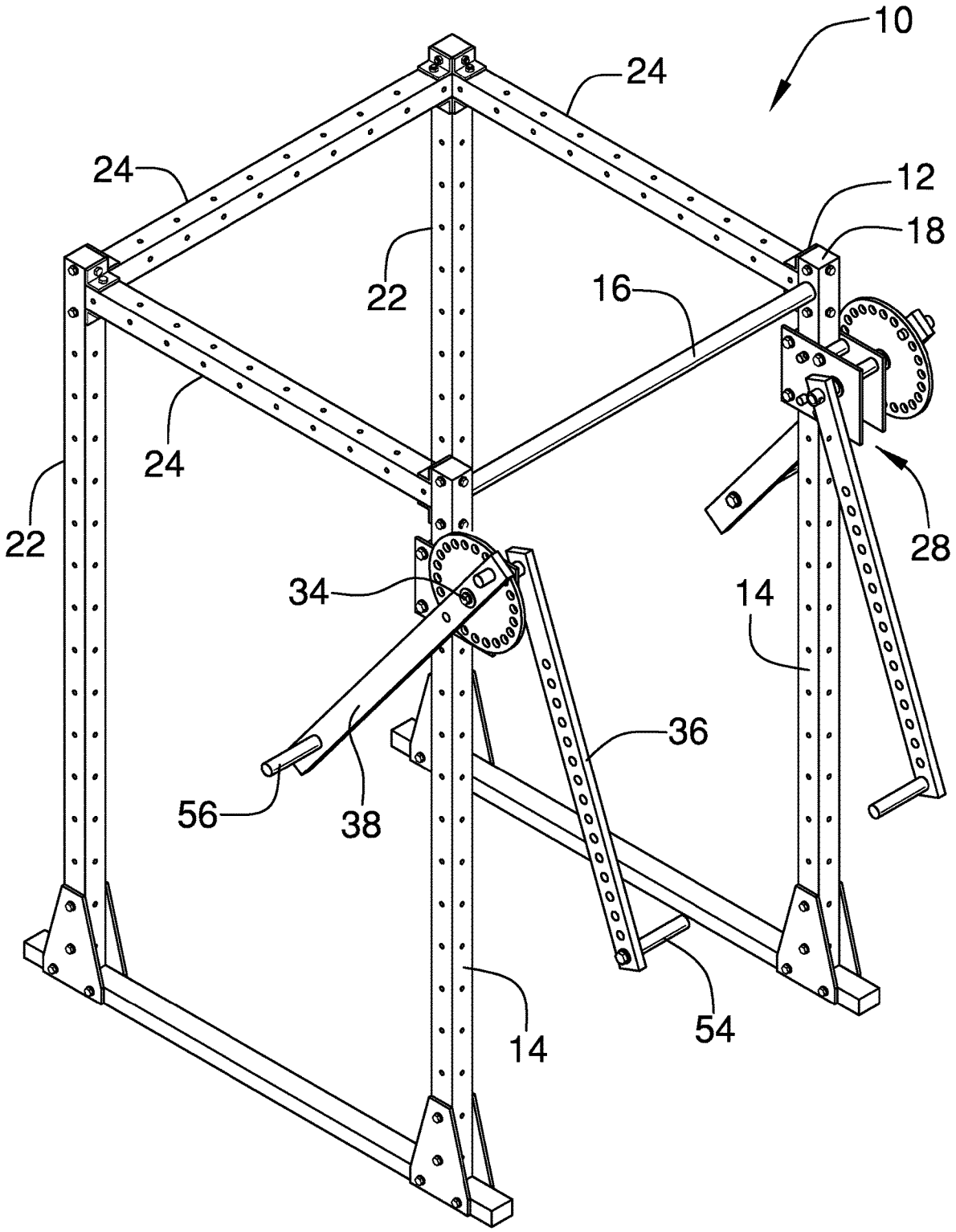
FIG. 1 is a front isometric view of a weightlifting exercising system according to an embodiment of the disclosure.
Figure 2:
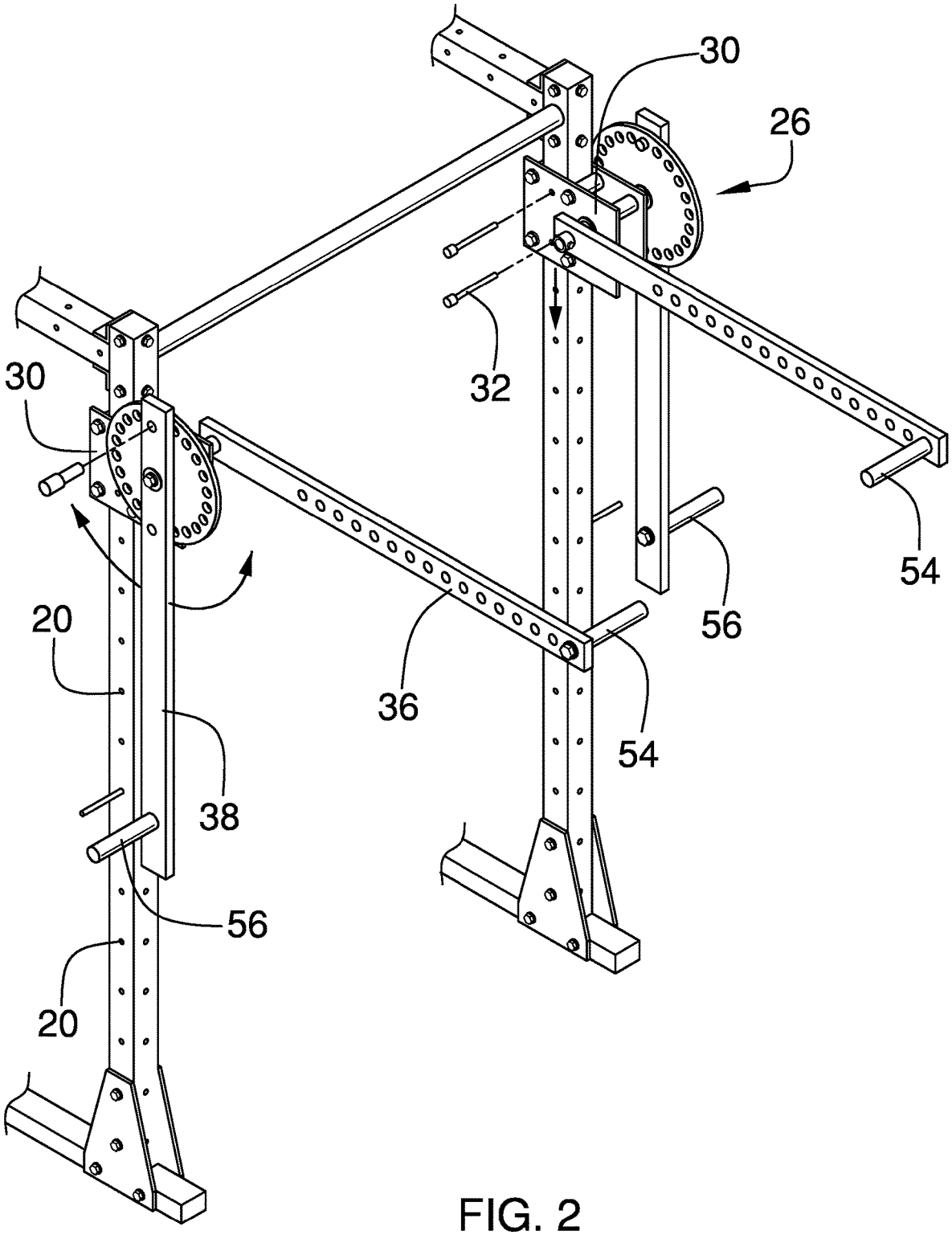
FIG. 2 is a front isometric view of an embodiment of the disclosure.
Figure 3:
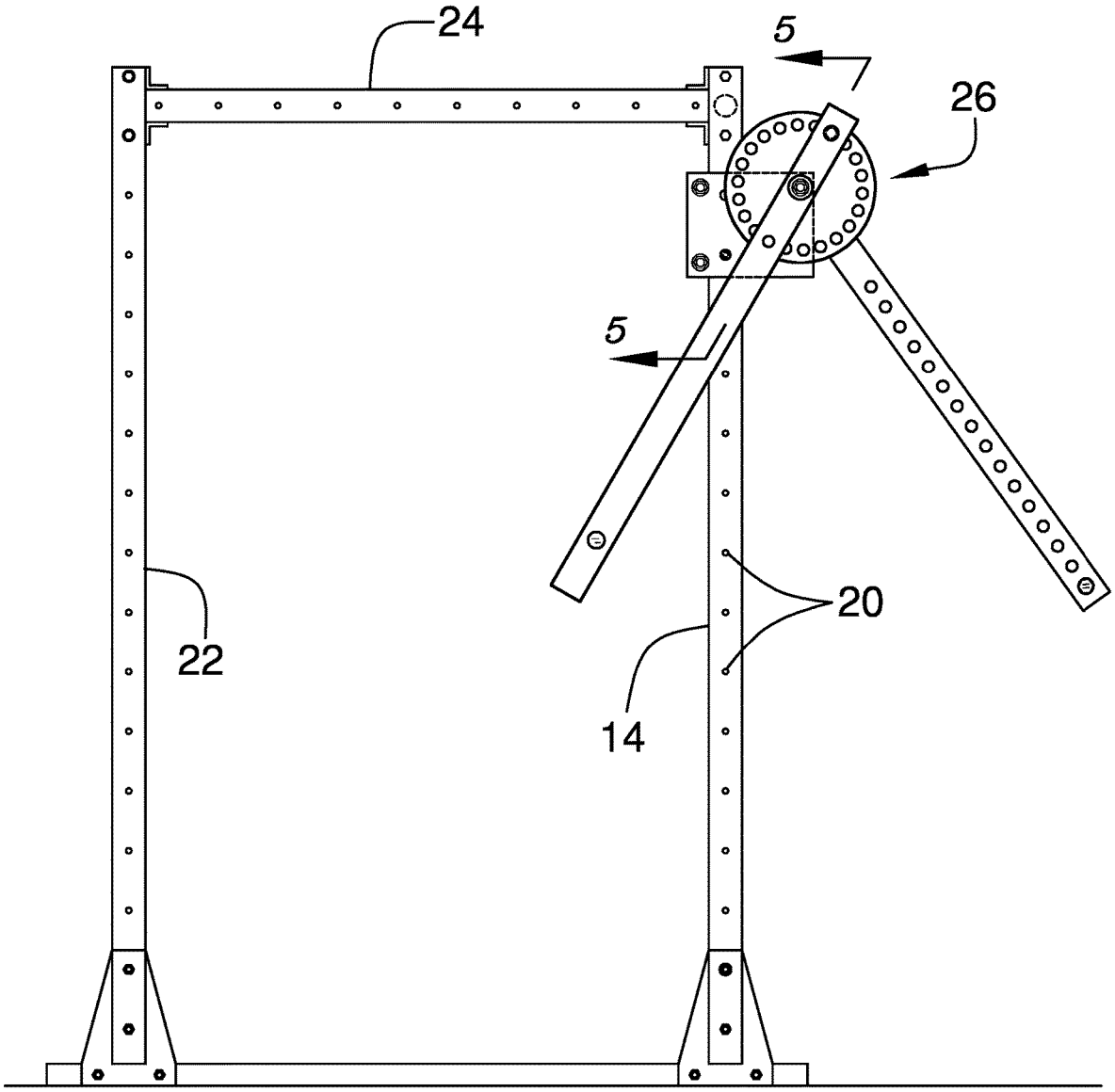
FIG. 3 is a side view of an embodiment of the disclosure.
Figure 4:
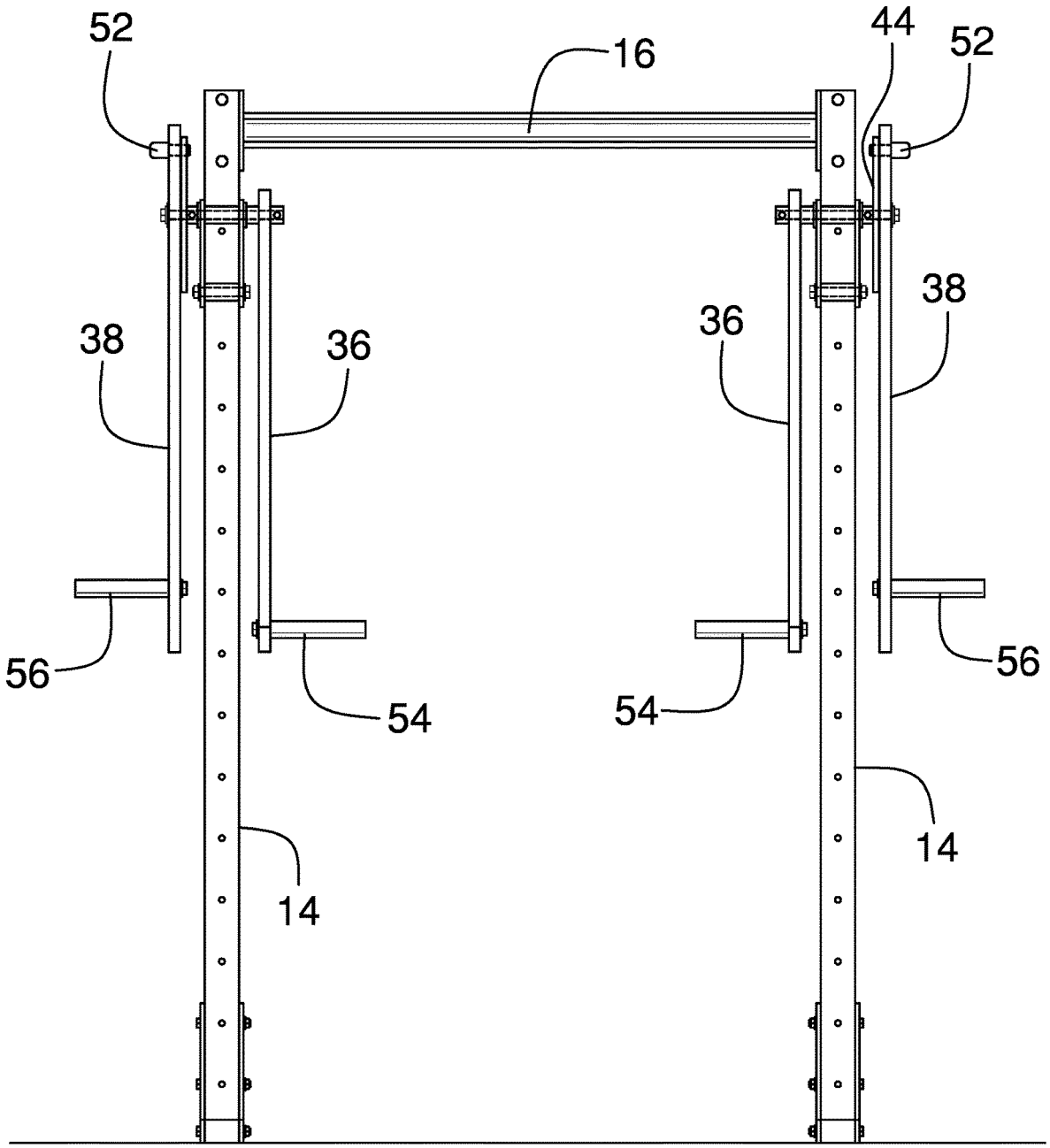
FIG. 4 is a front view of an embodiment of the disclosure.
Figure 5:
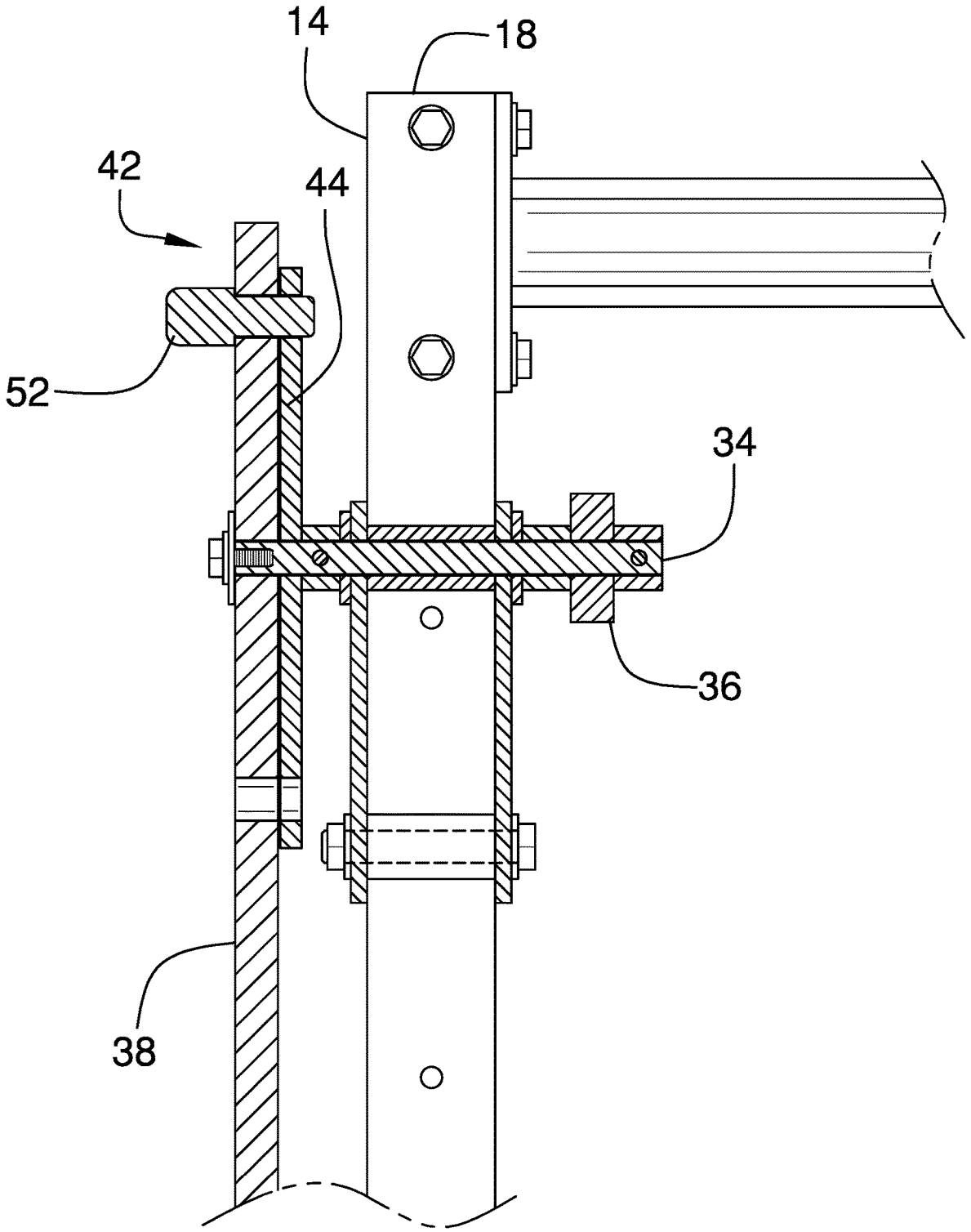
FIG. 5 is a cross-sectional view of an embodiment of the disclosure taken along line 5-5 of FIG. 3.

With reference now to the drawings, and in particular to FIGS. 1 through 20 thereof, a new exercising device embodying the principles and concepts of an embodiment of the disclosure and generally designated by the reference numeral 10 will be described.

As best illustrated in FIGS. 1 through 20, the weightlifting exercising system 10 generally comprises a frame 12 including a pair of columns 14. As shown in FIG. 1, each of the columns 14 is vertically orientated and the columns 14 are laterally spaced from each other. As can be seen in the Figures, the columns 14 are secured to each other such as with a beam 16 extending between upper ends 18 of the columns 14. The beam 16 may be cylindrical such that it can be used for exercises such as, but not limited to, pullups. Each of the columns 14 has a plurality of apertures 20 extending therethrough and are vertically aligned with each other. The frame 12 includes a pair of posts 22 laterally spaced from each other and secured to each other, wherein each of the posts 22 may be rearwardly aligned with one of the columns 14 such that the frame has a generally rectangular, box-like configuration and includes 4 vertical legs in total each having a height greater than 5.0 feet. A plurality of supports 24 is attached to and extends between each of the posts 22 and a forwardly associated one of the columns 14 to increase the stability of the frame 12. In some aspects, the frame 12 may define and also be used, independently of the system 10, as what is conventionally known as a squat rack comprised of rigid, metallic materials such as steel. The apertures 20 therefore may not only be positioned on lateral sides of the columns 14, but also on the posts 22, supports 24, and front and rear sides of each of the same.

A pair of lifting assemblies 26 is provided and are typically used in tandem with each other. The lifting assemblies 26, however, may be used in some circumstances independently from each other in a solo condition. Each of the columns 14 has one of the lifting assemblies 26 mounted thereon. In some embodiments, the lifting assemblies 26 are vertically movable along an associated one of the columns 14 for reasons which will become clear below. Each of the lifting assemblies 26 is releasably lockable at a selected position on the associated one of the columns 14. That is, the lifting assemblies 26 may be placed nearer or farther from the upper ends 18 of the columns 14 as needed.

Figure 6:
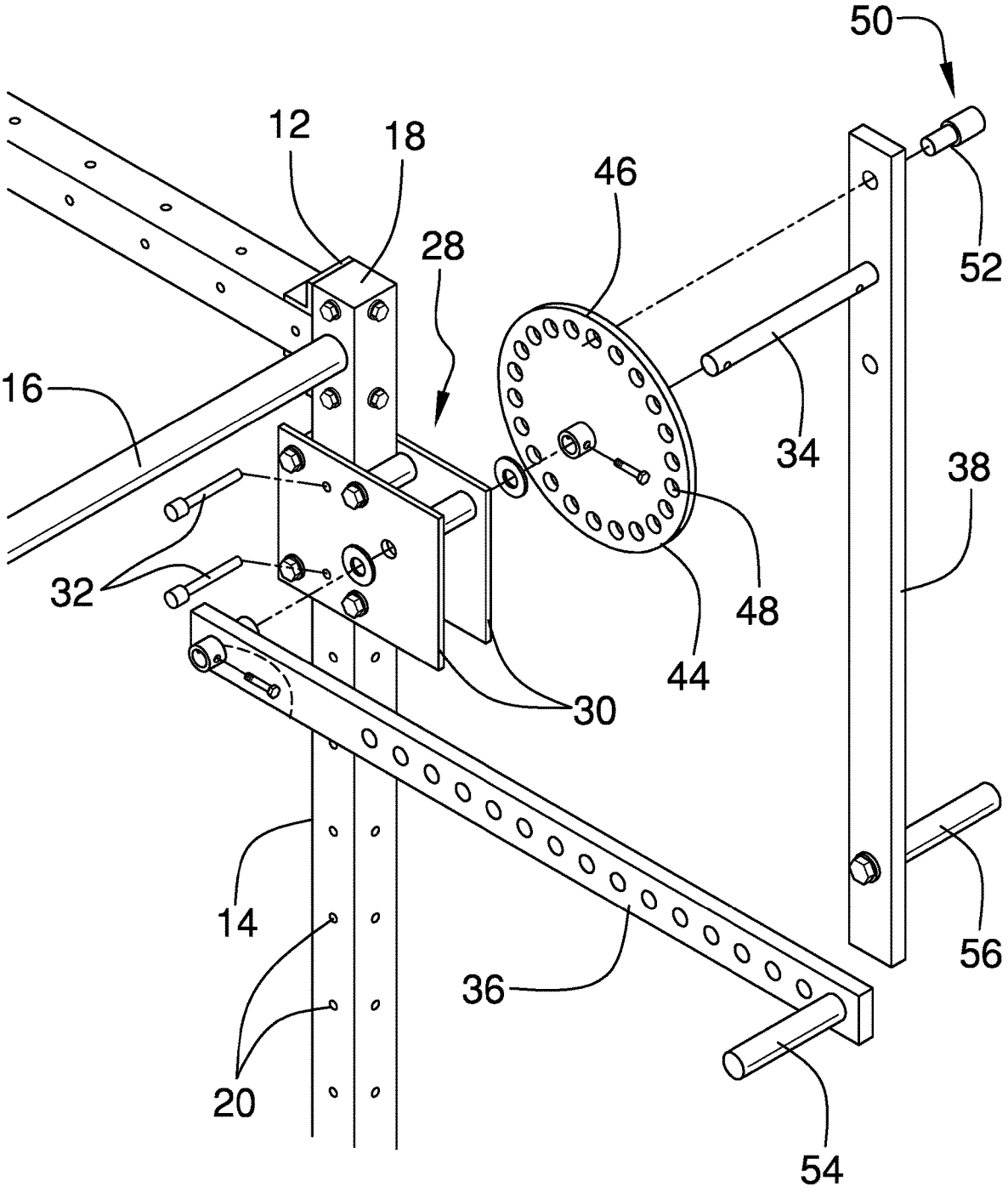
FIG. 6 is an exploded isometric view of an embodiment of the disclosure.
Figure 7:
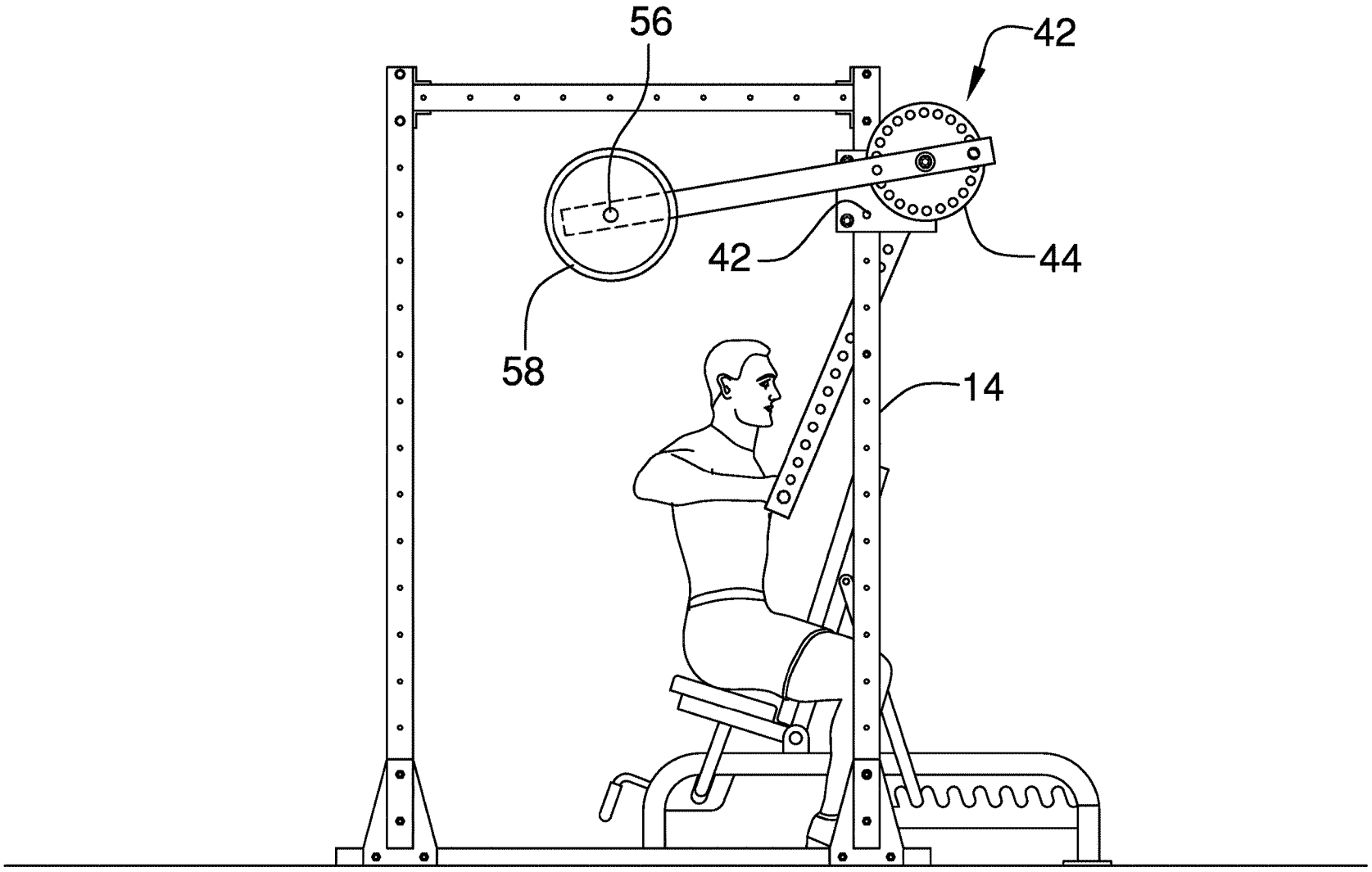
FIG. 7 is a side in-use view of an embodiment of the disclosure.

Each of the lifting assemblies 26 includes a mount 28 which releasably engages one of the columns 14. In some embodiments, the mount 28 generally extends around the associated one of the columns 14. As shown in FIG. 1, the mount 28 may include a pair of outer walls 30 positioned laterally to and on opposite sides of an associated one of the columns 14. The outer walls 30 are attached to each other and a pin 32 extends through the outer walls 30 and through one of the apertures 20 to releasably secure the mount 28 to the associated one of the columns 14. By removing the pin 32, the mount 28 can be moved upwardly and downwardly along the columns 14 to alter the height of the lifting assemblies 26 and accommodate different exercises to be performed by a user of the system 10. Alternate locking structures are known within the weightlifting arts that may be used for releasably securing a mount 28 to squat rack type frames. It should be understood that more than one pin 32 may be utilized as is shown in FIG. 6.

Figure 8:
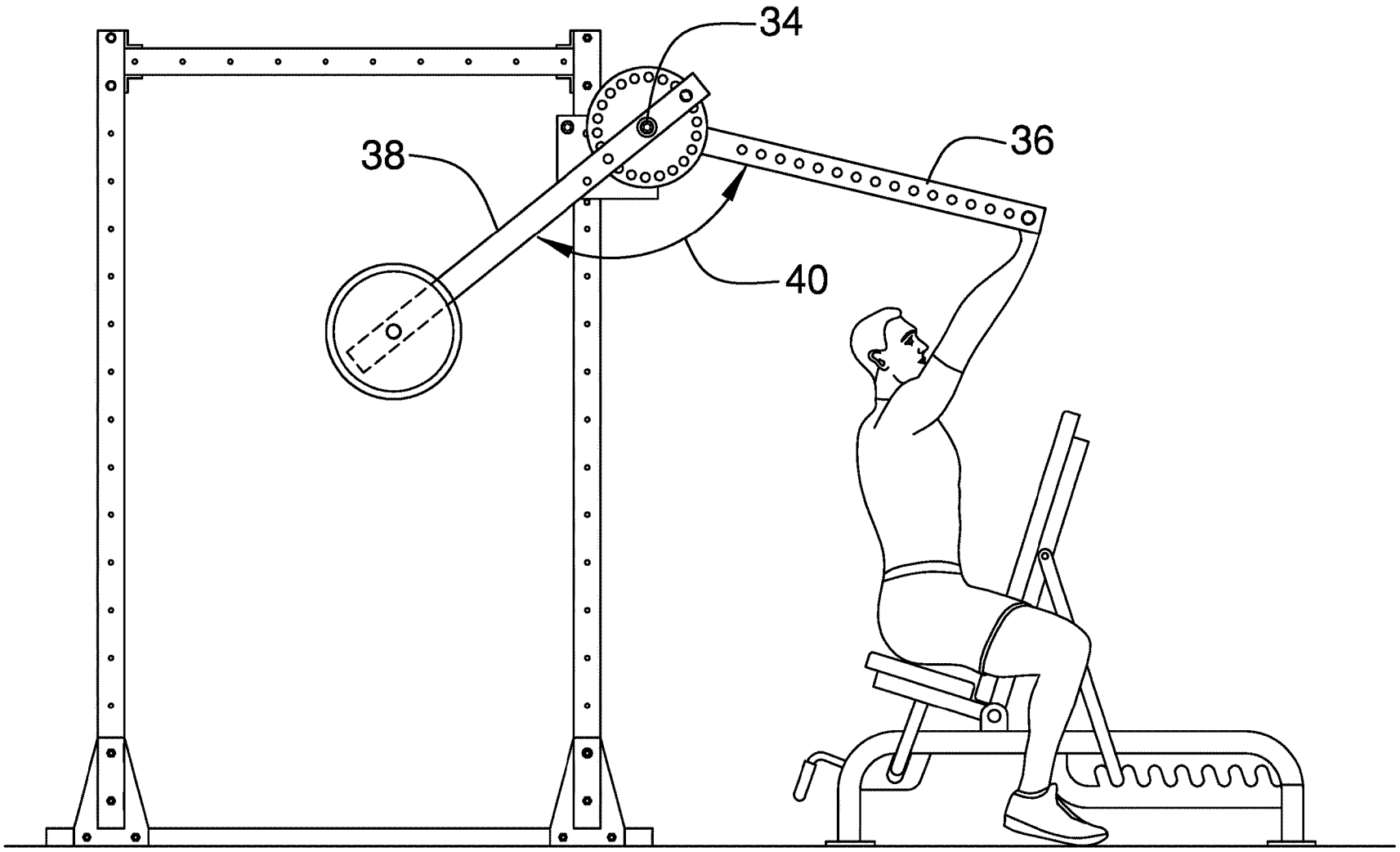
FIG. 8 is a side in-use view of an embodiment of the disclosure.
Figure 9:
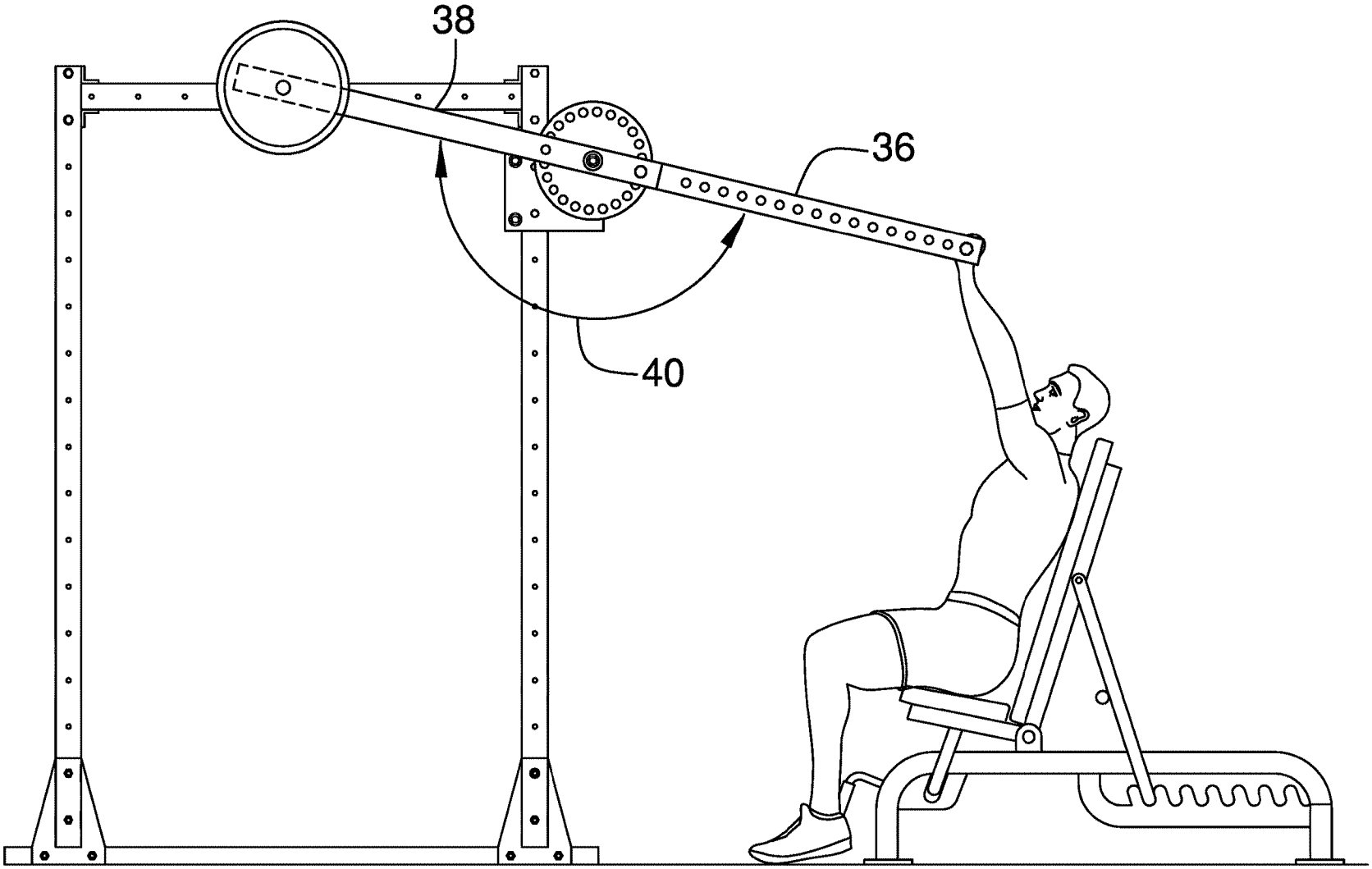
FIG. 9 is a side in-use view of an embodiment of the disclosure.

An axle 34 extends through the mount 28 and is rotational relative to the mount 28. The axle 34 is elongated and has a rotational axis extending along is length. Though not essential, the rotational axis will typically be horizontally orientated and be perpendicular to a longitudinal axis of each of the columns 14 which are most typically vertically orientated. A first arm 36 is fixedly attached to the axle 34 such that movement of the first arm 36 rotates the axle 34. The term "fixedly" herein use generally to define a static coupling and does not require the first arm 36 to be non-removably attached to the axle 34. A second arm 38 is rotationally coupled to the axle 34 such that the second arm 38 can rotate freely around the axle 34 without causing movement of the first arm 36. A lift angle 40, as shown in FIG. 8, is defined between the first 36 and second 38 arms wherein the axle 34 defines a vertex of the lift angle 40. Since the second arm 38 can rotate freely of the axle 34, the lift angle 40 is alterable from 0° to 180° in both directions. That is, the lift angle may be measured between −180° and 180°. The lift angle 40 is approximately 70° in FIG. 7, 0° in FIG. 10, 10° in FIG. 11, and 135° in FIG. 8.

A locking member 42 releasably locks the second arm 38 with respect to the axle 34 such that the lift angle 40 is releasably retained at a selected measurement. In one embodiment, the locking member 42 comprises a plate 44 that is mounted onto and fixedly coupled to the axle 34. The plate 44 lies in a plane orientated perpendicular to the axis of rotation of the axle 34. The plate 44 has a perimeter edge 46 and a plurality of receivers 48 extend into the plate 44. In some embodiments, the plate 44 is circular and the receivers 48 comprise openings extending through the plate 44. The receivers 48 will typically be equidistance from the axle 34 and positioned adjacent to the perimeter edge 46. A coupler 50 engages the second arm 38 and is releasably engaged with one of the receivers 48 to lock the second arm 38 relative to the plate 44, and thereby lock a position of the second arm 38 relative to the axle 34 and the first arm 36. The coupler 50 may comprise a rod 52, or a plurality of rods 52, extending through the second arm 38 and into one of the receivers 48.

A handle 54 and a weight receiver 56 are each provided for each lifting assembly 26. One of the first 36 and second 38 arms has the handle 54 attached thereto and the other of the first 36 and second 38 arms has the weight receiver 56 attached thereto. The hand 54 is used for gripping the lifting assembly 26 by a user of the system 10. The handle 54 extends inwardly toward the other one of the lifting assemblies 26 and the weight receiver 56 extends outwardly away from the other one of the lifting assemblies 26. Which of the first 36 and second 38 arms includes handle 54 or weight 56 receiver will not affect the operation of the system 10. Since each lift assembly 26 includes one first arm 36 and one second arm 38, one of the first 36 and second 38 arms will be positioned inside of column 14 to which it is attached, and one of the first 36 and second 38 arms will be positioned outside of that column 14. The term "inside" as used herein is intended to define as being between the columns 14. Moreover, functionality is not affected by which of the outside or inside arms is the one which is fixed versus rotatable relative to the axle 34. Finally, some embodiments may place both arms 36, 38 outside or inside of the columns 14.

In one embodiment, shown in the Figures, the handle 54 is attached to first arm 36 and the first arm 36 is positioned between the columns 14. In this embodiment, the weight receiver 56 is attached to the second arm 38 and is positioned outside of the columns 14 and the plate 44 is positioned between the frame 12 and the second arm 38. Conventional weight plates 58 include a central opening for receiving a typical weightlifting bar. The weight receiver 56 therefore may comprise a shaft onto which one or more weight plates 58 is positioned.

The first 36 and second 38 arms each form a fixed angle relative to the axle 34. The fixed angle is between 60° and 120°. That is, at the point where each of the first 36 and second 38 arms extend away from the axle 34 will form an angle between 60° and 120°. However, the first 36 and second 38 arms will often form a 90° with the axle 34 as is apparent in FIG. 4. The first 36 and second 36 arms may include bends therein, as opposed to being straight as shown in the Figures, to better position the handles 54 or weight plates 58 nearer or farther away from each other to prevent interference with a user of the system 10 or with the columns 14.

Figure 10:
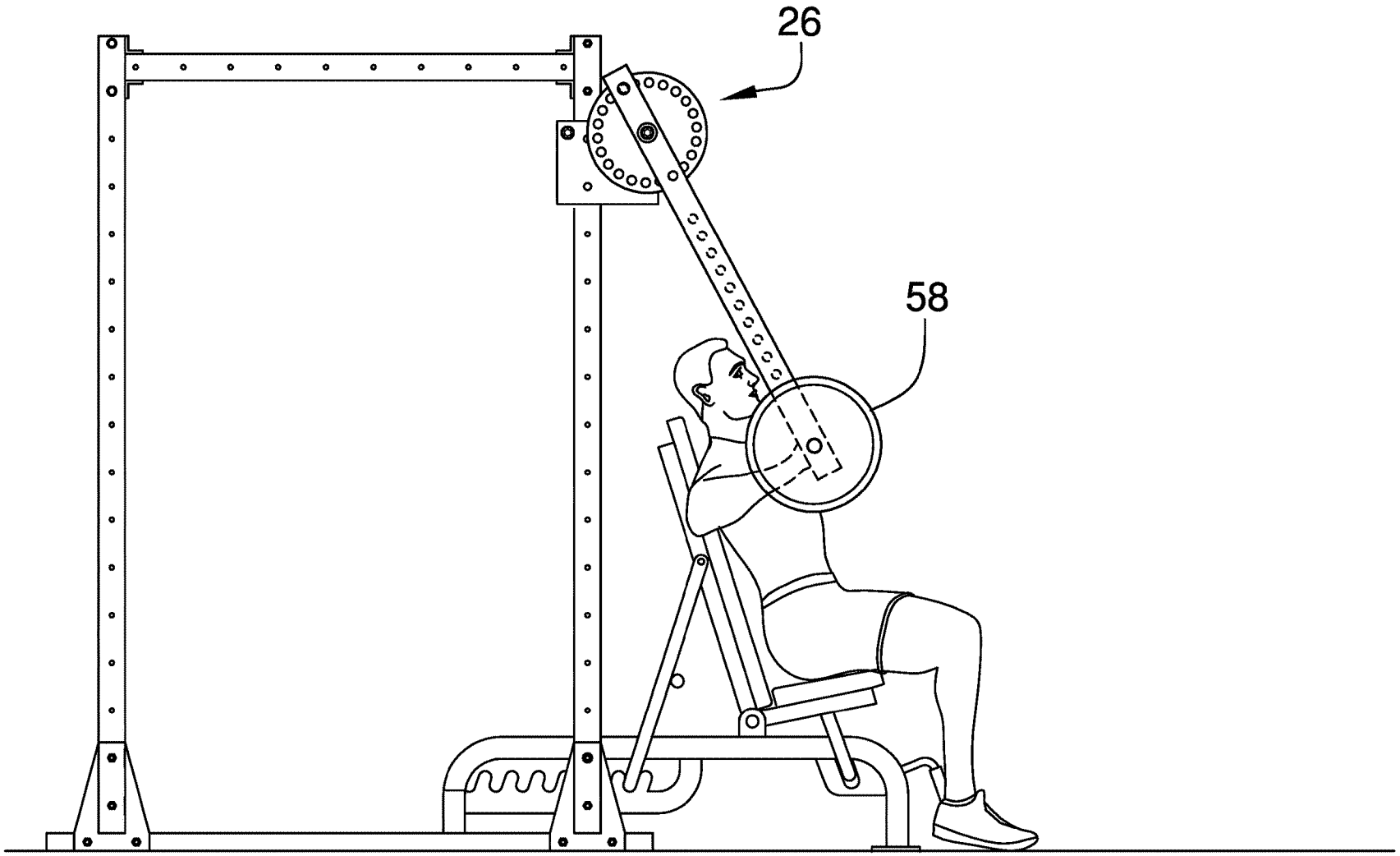
FIG. 10 is a side in-use view of an embodiment of the disclosure.
Figure 11:
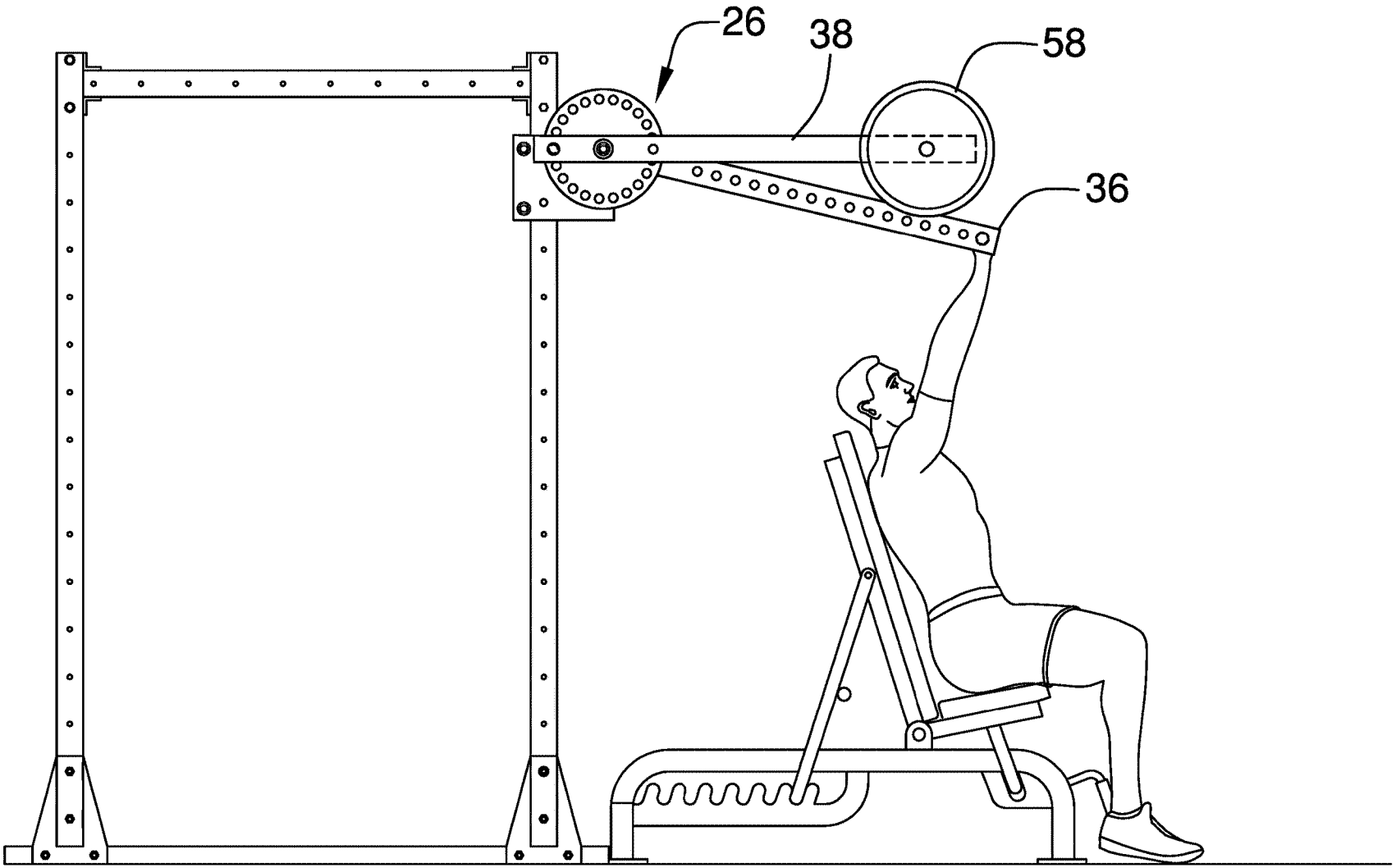
FIG. 11 is a side in-use view of an embodiment of the disclosure.
Figure 12:
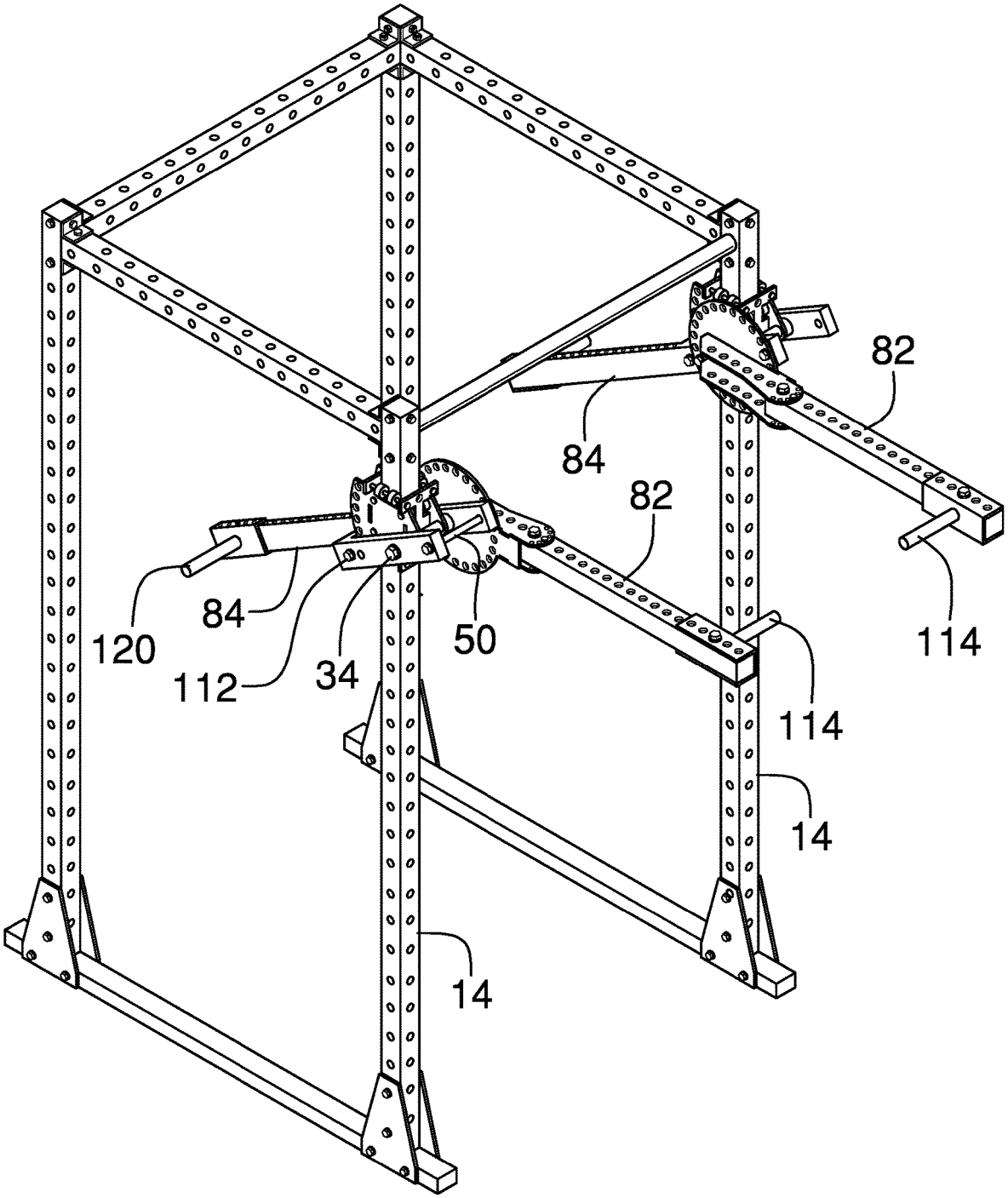
FIG. 12 is a front isometric view of another embodiment of a weightlifting exercising system according to an embodiment of the disclosure.
Figure 13:
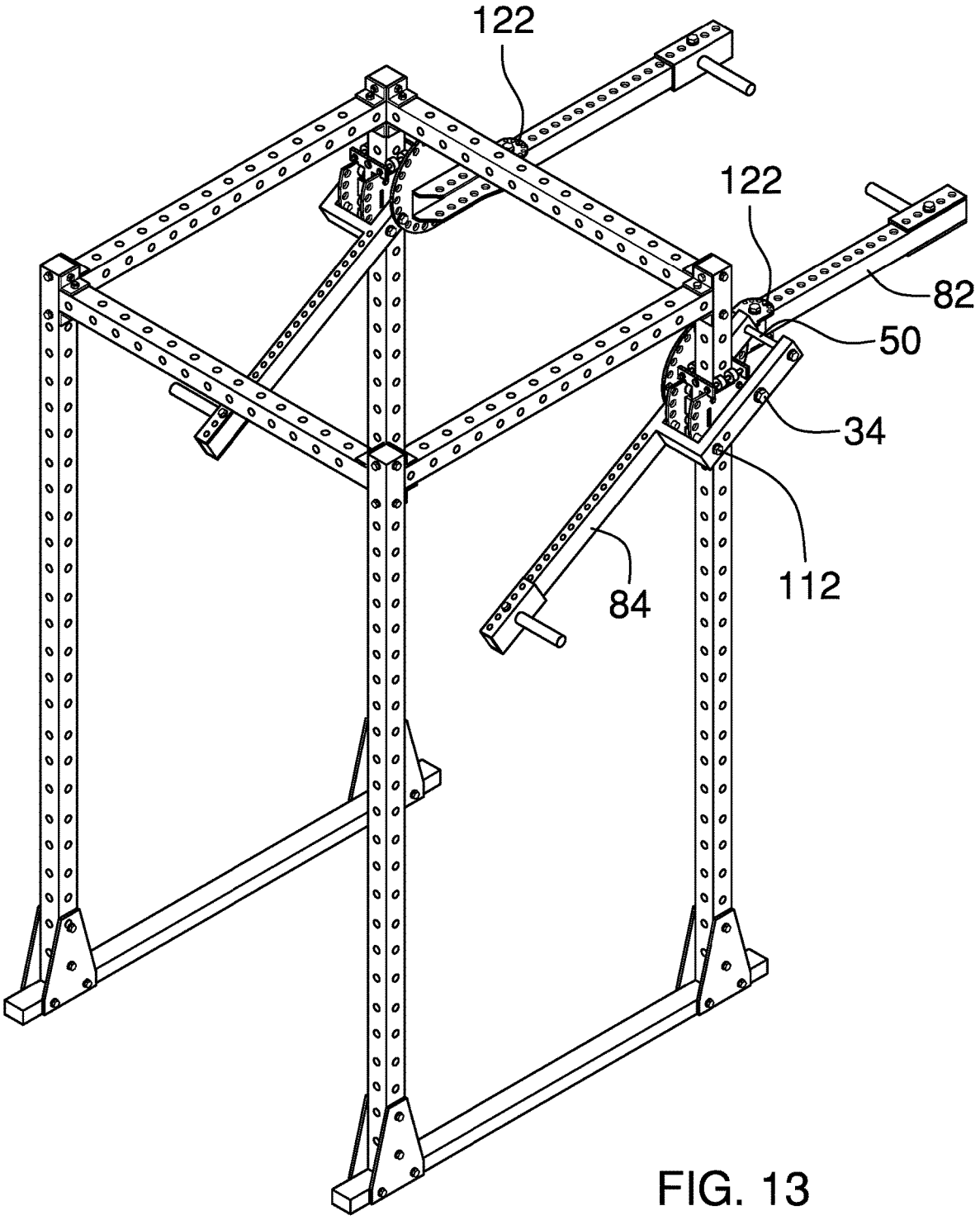
FIG. 13 is a rear isometric view of an embodiment of the disclosure shown in FIG. 12.

Generally, during use, system 10 allows a person performing exercises to utilize a squat rack, i.e. frame 12, to perform multiple different exercises by altering the vertical location of the lift assemblies 26 on the columns 14 and by altering the lift angle 40. For example, the lift assemblies 26 may be lowered to lower position such that a person lying on a bench will utilize a 0° lift angle and lift the weight plates upwardly in a conventional bench press type exercise to exercise the pectoral muscles. A similar exercise may be achieved with a 90° lift angle wherein the user faces away from the frame and sits up, the first arms 36 extend down, and the second arms 38 extend forward. Thus, when the first arms 36 are pushed forward the user will receive an upper pectoral exercise. Location of the bench will also affect the exercise as FIG. 10 is a pectoral exercise while FIG. 11 exercises the shoulders. The user may also use a greater lift angle 40 such as in FIG. 8 and then pull down the first arms 36 for back exercises, or the user may be seated and while facing a backrest of the bench and the frame 12 to pull the first arms 36, which are extending downwardly, toward the user. Other exercises including different squatting, bicep and triceps exercises may be performed as well as other variations of all exercises requiring either the pulling or pushing of weight. The point of greatest force may be altered by the changing of the lift angle 40 such that the relative position of the weight plates 58 to the axle 34 is altered.

Though not shown, stops may be incorporated with the system 10, such as which engage the axle 34, the first 36 or second 38 arms, the column 14, or the mount 28 to releasably prevent movement of the weight receiver 56 and second arm 38 beyond a particular level. For example, in the embodiment of FIG. 8, this may include a stop positioned on the mount 28 or the column 14 to prevent the second arm 38 from swinging toward the user.

Figure 14:
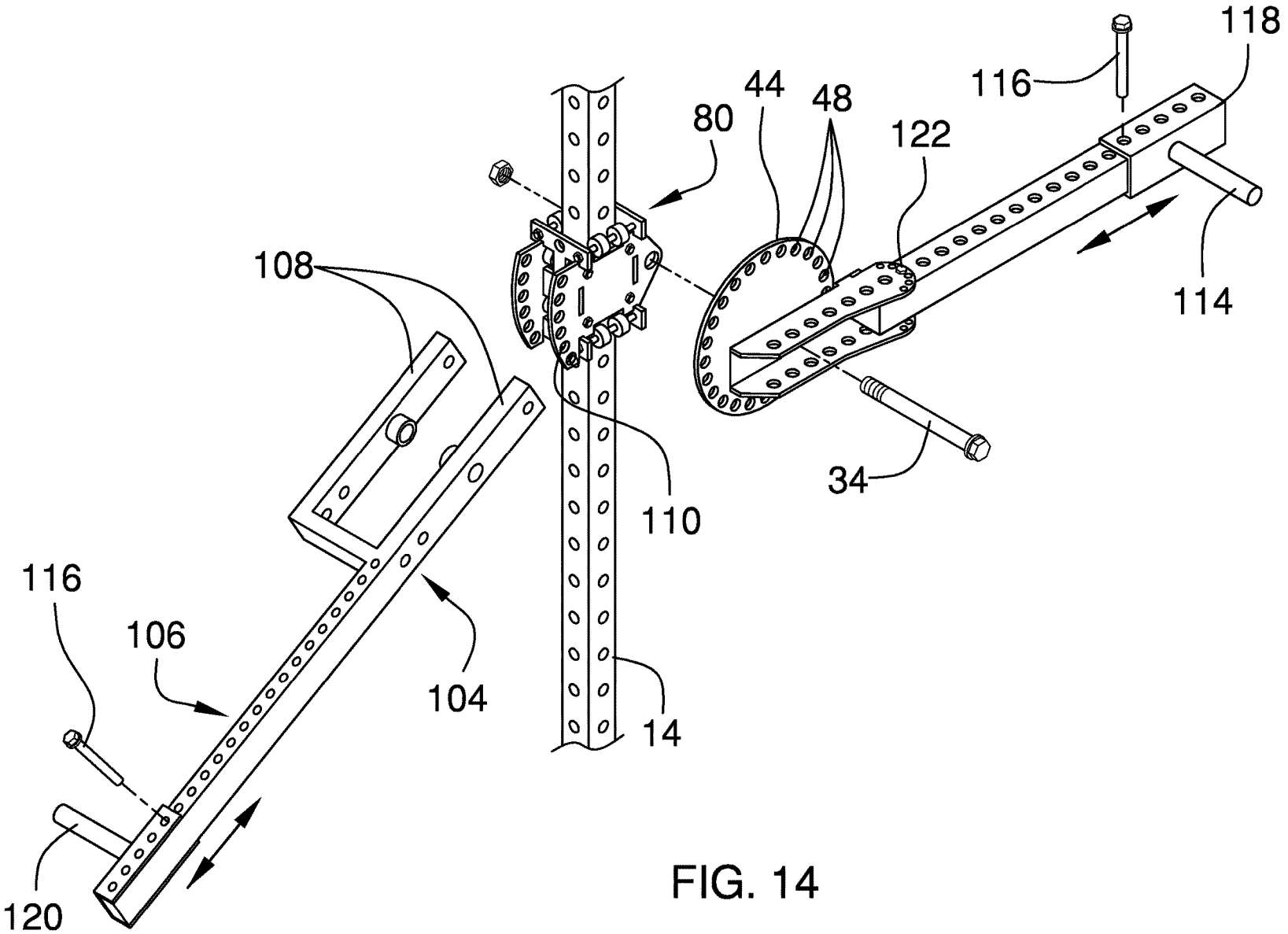
FIG. 14 is an exploded, side isometric view of an embodiment of the disclosure shown in FIG. 12.
Figure 15:
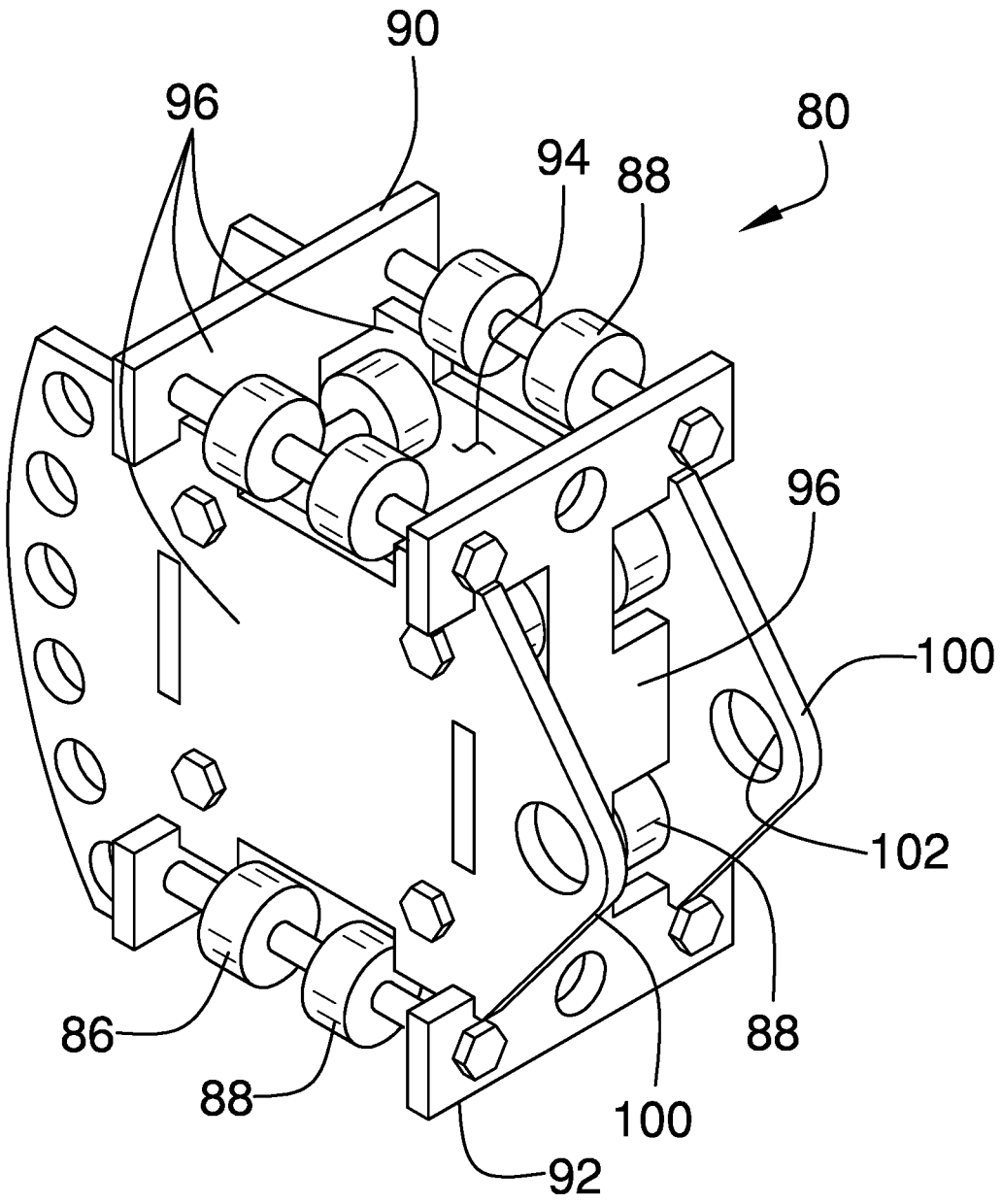
FIG. 15 is a front isometric view of a mount of an embodiment of the disclosure shown in FIG. 12.
Figure 16:
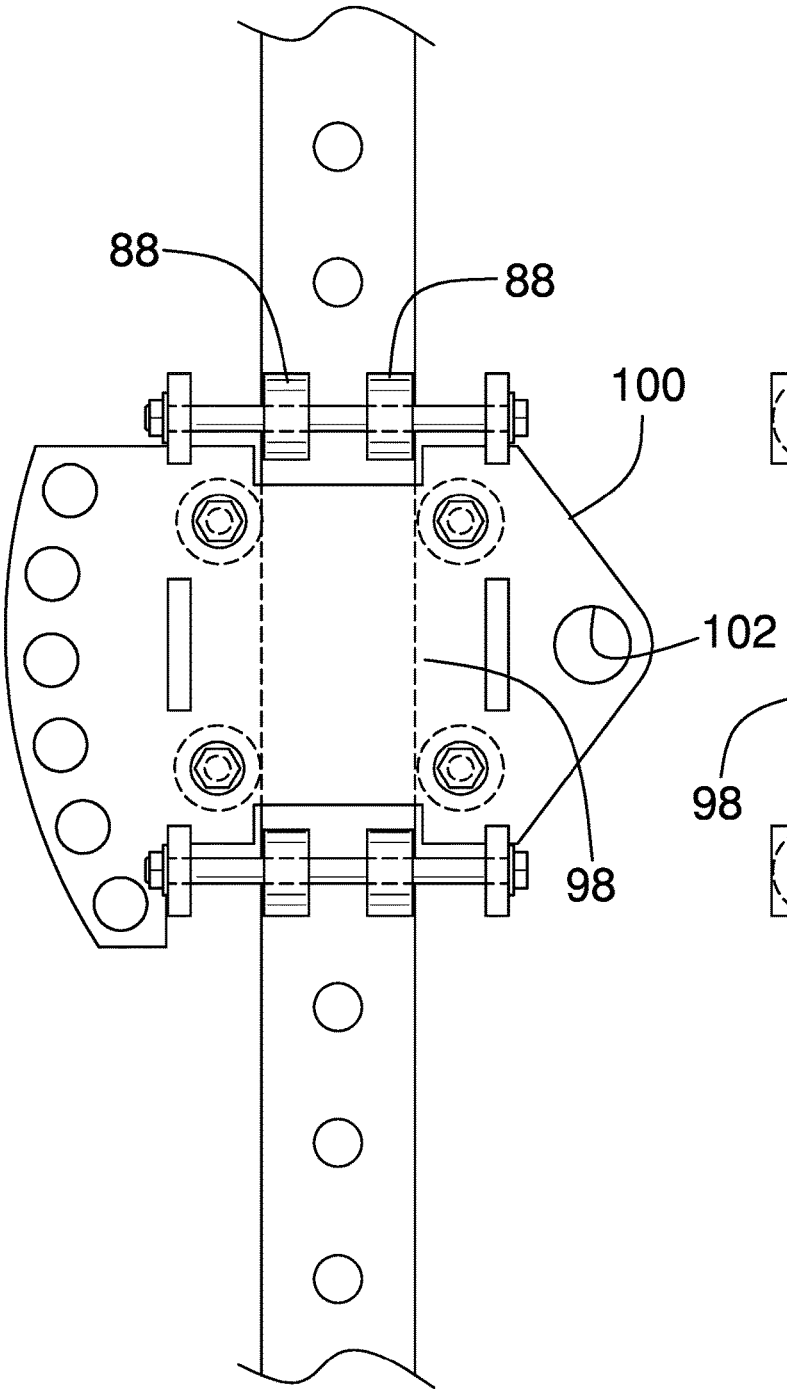
FIG. 16 is a side view of an embodiment of the mount of the disclosure shown in FIG. 12.
Figure 17:
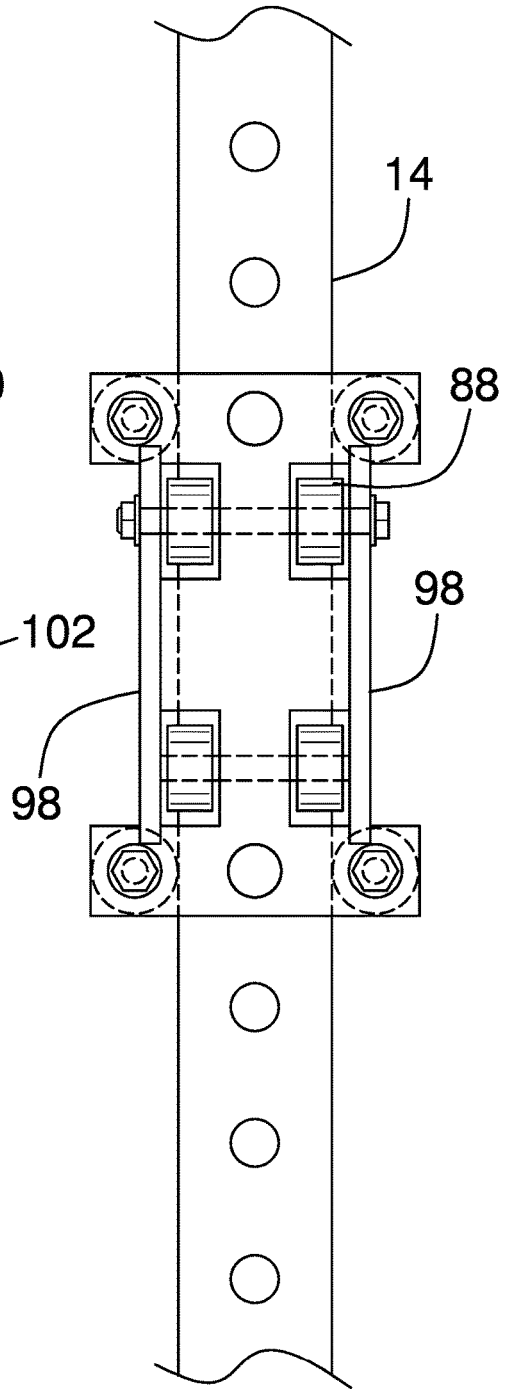
FIG. 17 is a rear view of an embodiment of the mount of the disclosure shown in FIG. 12.
Figure 18:
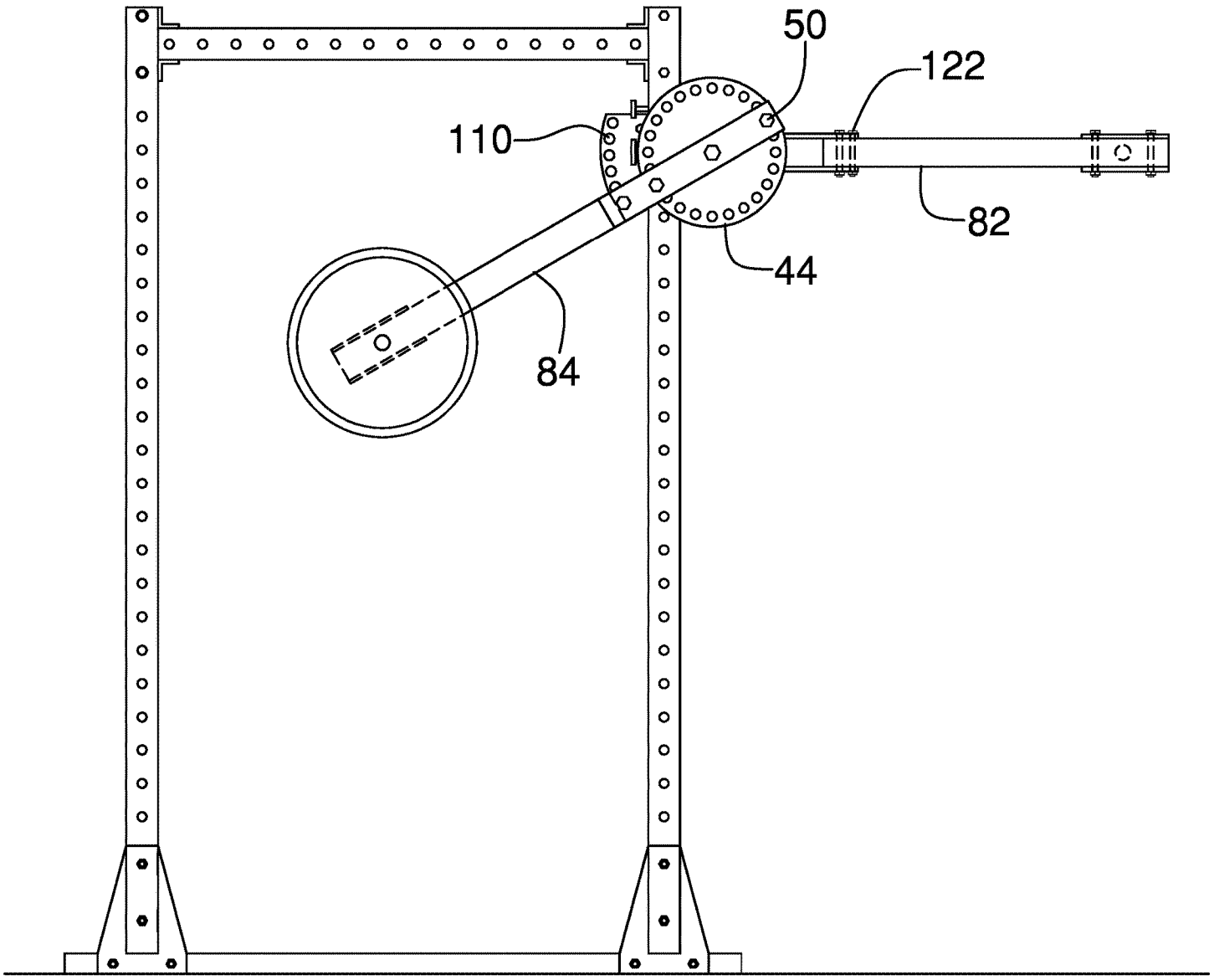
FIG. 18 is a side view of the embodiment of the disclosure shown in FIG. 12.

Another embodiment depicted in FIGS. 12 through 18 includes a mount 80 and first 82 and second 84 arm variations that may be utilized in a generally similar manner to the version shown in FIGS. 1-11. In this embodiment, the mount 80 comprises a sleeve 86 extending around a column 14 and including rollers 88, which may comprise wheels, bearings, or other spinning/rotatably contacts, rotatably coupled to the mount 80 and positioned between the mount 80 and the column 14. The rollers 88 abut the column 14 such that the mount 80 more easily travels upwardly and downwardly along the column 14. As can be seen in the Figures, the mount 80 includes an open top end 90 and an open bottom end 92 each being open for receiving the column 14. Between the top 90 and bottom 92 ends is an interior surface 94 comprising four side walls 96. Each of the side walls 96 includes one or more rollers 88 having being able to rotate about a horizontal axis. In one embodiment, as shown in FIG. 15, each side wall 96 of the mount 80 includes a pair of rollers 88 mounted adjacent to the top end 90 and a pair of rollers 88 mounted adjacent to the bottom end 92.

The mount 80 includes a pair of lateral walls 98 which correspond to the outer walls 30 of the embodiment described above. Each of the lateral walls 98 includes a pair of flanges 100 each extending in a same direction with respect to each other. The flanges 100 lie in vertical planes orientated perpendicular to the axle 34 and each includes an axle opening 102 for receiving the axle 34. The locking assembly 26 includes the plate 44 being statically coupled to the first arm 82 and the axle 34 extends through the plate 44, the first arm 82 and the second arm 84. The coupler 50 extends through a selected one of the receivers 48 in the plate 44 and through the second arm 84 to adjust the angle of the second arm 84 relative to the first arm 82. As can be seen in FIG. 14, the second arm 84 may have a proximal portion 104 and a distal portion 106 with respect to the axle 34 wherein the distal portion 106 is a single elongated member and wherein the proximal portion 104 forms a pair of fingers 108 having a space between them. The mount 80 is positioned between the fingers 108 and each of the coupler 50 and the axle 34 extends through both fingers 108. This structure more evenly distributes the amount of force across the mount 80 and the first 82 and second 84 arms. The mount 80 may include locking apertures 110 wherein a pin 112 is extendable through one of the locking apertures 110 and the fingers 108 to prevent movement of the second arm 84 relative to the column 14 such as when loading weight plates 58.

FIG. 14 additionally shows a handle 114 movably positioned on the first arm 82 for allowing the handle 114 to be moved closer to, or farther away from, the axle 34. In this embodiment, a pin 116 extends through a slide 118 on which the handle 114 is mounted and through one of a plurality of holes extending through and along a length of the first arm 82. In a similar manner the weight receiver 120 of FIG. 14 may also be movable along the length of the second arm 84 and secured in place with a pin 116. The ability to move the handle 114 and weight receiver 120 will understandably facilitate the ability to alter the amount of weight being lifted as well as the amount of movement encountered during a particular exercise. The first arm 82 may additionally include a break to allow an angle of the first arm 82 to be altered to move the handle 114 laterally relative to the column 14. A pin 122 extending through sections of the first arm 82 to retain a bend in the first arm 82 at a selected angle.

Figure 19:
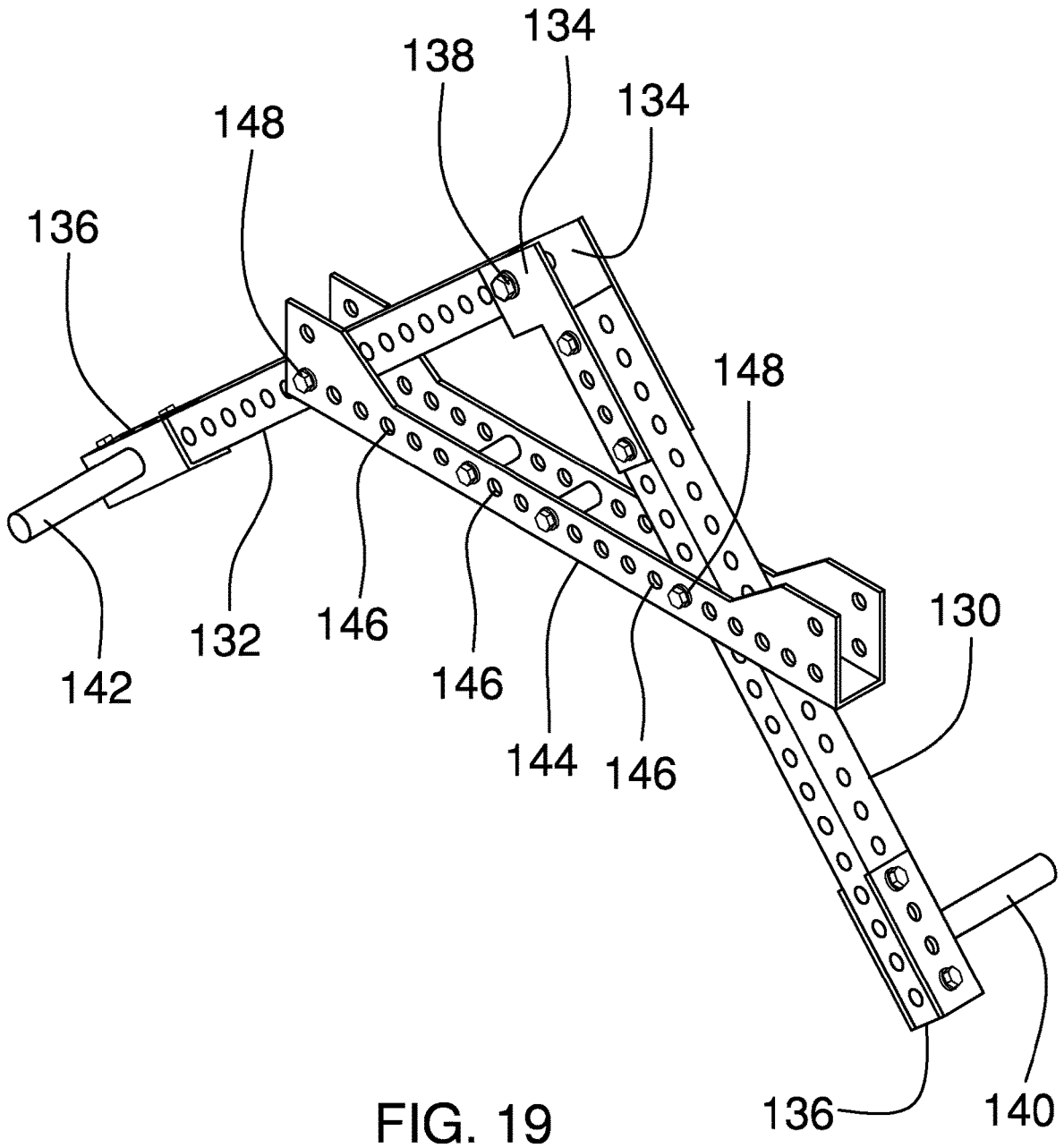
FIG. 19 is a side isometric view of a third embodiment of the disclosure.
Figure 20:
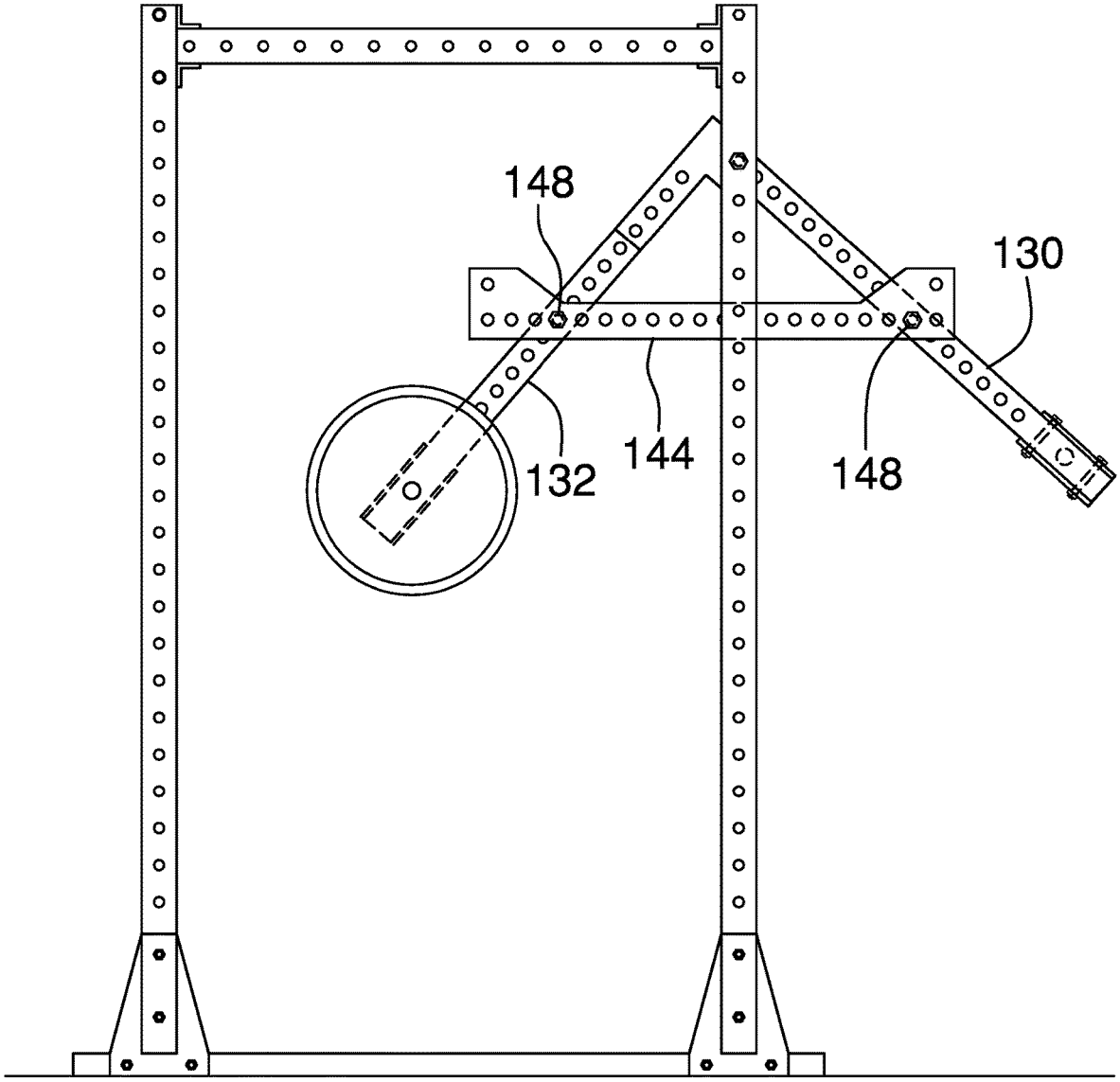
FIG. 20 is a side view of the fourth embodiment of the disclosure.

FIGS. 19 and 20 demonstrate an embodiment which still include a first arm 130 and a second arm 132 each having a first end 134 and a second end 136. Their first ends 134 are pivotally coupled together with an axle 138 extending through the column 14. The handle 140 and weight receiver 142 are each positioned or positionable adjacent to the second ends 136. However, instead of a plate 44 as utilized in the above embodiments, a brace 144 is provided through which extends, spaced along its length, a plurality of coupling points 146. The coupling points 146 comprise holes alignable with selected ones of the holes in the first 134 and second 136 arms. As should be readily understood, a user of this embodiment may easily alter the angle between the first 134 and second 136 arms by selecting different connection locations between the brace 144 and the first 134 and second 136 arms and extending rods 148 through aligned ones of the coupling points 146 and holes in the first 134 and second 136 arms.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An exercising assembly being configurable to allow a plurality of different exercises, the exercising assembly including:

a frame including a pair of columns;

a pair of lifting assemblies, each of the columns having one of the lifting assemblies mounted thereon, each of the lifting assemblies including:

a mount releasably engaging one of the columns, wherein the mount comprises a sleeve extending around an associated one of the columns, a plurality of rollers being rotatably mounted on said mount and being positioned between the mount and the associated column to facilitate movement of the mount along said column, said column being vertically orientated, an axle being horizontally orientated, an open top end and an open bottom end for receiving the column, an interior surface of said mount extending between said top and bottom ends, said interior surface comprising four side walls, each one of said four side walls including at least one of said rollers, said rollers being rotatable about a horizontal axis, and wherein the four side walls include a pair of lateral walls positioned on opposite sides of the associated one of said columns, each of the lateral walls includes a pair of flanges each extending in a same direction with respect to each other, said flanges lying in vertical planes orientated perpendicular to the axle and each including an axle opening for receiving the axle, said axle extending through the mount and being rotational relative to the mount, the axle having rotational axis;

a first arm and a second arm each being mounted on the axle, a lift angle being defined between the first and second arms wherein the axle defines a vertex of the lift angle, the first and second arms being rotatable about the axle independently of each other such that the lift angle is alterable from 0° to 180°; the second arm having a proximal portion and a distal portion with respect to the axle wherein the distal portion comprises a single elongated member and wherein the proximal portion forms a pair of fingers, a space being defined between the fingers, the mount being positioned between the fingers, the mount being positioned in the space between the fingers;

a locking member releasably locking the first and second arms with respect to each other such that the lift angle is releasably retained, wherein the locking member includes:

a plate being mounted on and fixedly coupled to the first arm, the plate lying in a plane orientated perpendicular to the axis of rotation, a plurality of receivers extending into the plate, the receivers being equidistance from the axle; and a coupler extending through a selected one of the receivers in the plate and through the second arm to retain the first and second arms at a selected angle with respect to each other, said coupler and said axle each extending though each of the fingers; and a handle and a weight receiver, one of the first and second arms having the handle attached thereto and the other of the first and second arms having the weight receiver attached thereto, wherein the weight receiver is configured to removably receive one or more weight plates.

2. The exercising assembly according to claim 1, wherein each of the columns are vertically orientated, the columns being laterally spaced from each other and being secured to each other.

3. The exercising assembly according to claim 2, wherein each of the columns has a plurality of apertures extending therethrough and being vertically aligned with each other.

4. The exercising assembly according to claim 2, wherein the lifting assemblies are vertically movable along an associated one of the columns, each of the lifting assemblies being releasably lockable at a selected position on the associated one of the columns.

5. The exercising assembly according to claim 4, wherein each of the lifting assemblies further includes the rotational axis being horizontally orientated, a longitudinal axis of each of the columns being vertically orientated.

6. The exercising assembly according to claim 5, wherein each of the lifting assemblies further includes the first and second arms each forming a fixed angle relative to the axle being between 60° and 120°.

7. The exercising assembly according to claim 5, wherein each of the locking member includes:

the plate being mounted on and fixedly coupled to the axle, the plate lying in a plane orientated perpendicular to the axis of rotation, a plurality of receivers extending into the plate, the receivers being equidistance from the axle;

the coupler engaging the second arm and being releasably engaged with one of the receivers, the coupler comprising a rod extending through the second arm and into one of the receivers.

8. The exercising assembly according to claim 5, wherein each of the lifting assemblies further includes:

the handle extending inwardly toward the other one of the lifting assemblies; and the weight receiver extending outwardly away from the other one of the lifting assemblies.

9. The exercising assembly according to claim 8, wherein each of the lifting assemblies further includes:

the handle being attached to first arm, the first arm being positioned between the columns; and the weight receiver being attached to the second arm and being positioned outside of the columns, the plate being between the frame and the second arm.

10. The exercising assembly according to claim 4, wherein each of the columns has a plurality of apertures extending therethrough and being vertically aligned with each other.

11. The exercising assembly according to claim 10, wherein each of the lifting assemblies further includes the outer walls being attached to each other, a pin extending through the outer walls and through one of the apertures to releasably secure the mount to the associated one of the columns.

12. The exercising assembly according to claim 4, wherein the frame includes a pair of posts laterally spaced from each other and secured to each other, each of the posts being rearwardly aligned with one of the columns, a plurality of supports being attached to and extending between each of the rear posts and a forwardly associated one of the columns, the frame defining a squat rack.

13. The exercising assembly according to claim 1, wherein the first arm is fixedly coupled to said axle.

14. The exercising assembly according to claim 1, wherein said handle and said weight receiver are selectively positionable along a length of corresponding ones of the first and second arms.

* * * * *